US009027370B2

(12) United States Patent
Leibman et al.

(10) Patent No.: US 9,027,370 B2
(45) Date of Patent: May 12, 2015

(54) FLUID ADDITIVE DISPENSER

(75) Inventors: Alexander Boris Leibman, Louisville, KY (US); Alaknanda Acharya, Louisville, KY (US); Taranjeet Singh, Hyberabad (IN)

(73) Assignee: General Electric Company, Scnenectady, NY (US)

( * ) Notice: Subject to any disclaimer, the term of this patent is extended or adjusted under 35 U.S.C. 154(b) by 74 days.

(21) Appl. No.: 13/490,939

(22) Filed: Jun. 7, 2012

(65) Prior Publication Data

US 2013/0327101 A1 Dec. 12, 2013

(51) Int. Cl.

| | |
|---|---|
| ***D06F 21/06*** | (2006.01) |
| ***D06F 23/04*** | (2006.01) |
| ***D06F 37/12*** | (2006.01) |
| ***D06F 37/24*** | (2006.01) |
| ***D06F 39/02*** | (2006.01) |
| ***D06F 71/10*** | (2006.01) |

(52) U.S. Cl.

CPC ..... *D06F 39/022* (2013.01); *D06F 71/10* (2013.01); *D06F 23/04* (2013.01); *D06F 37/12* (2013.01); *D06F 37/24* (2013.01); *D06F 21/06* (2013.01); *D06F 39/02* (2013.01)

(58) Field of Classification Search

None

See application file for complete search history.

(56) References Cited

U.S. PATENT DOCUMENTS

| | | | | |
|---|---|---|---|---|
| 6,065,171 | A * | 5/2000 | Tubman et al. | 8/158 |
| 6,523,371 | B1 * | 2/2003 | Sherratt et al. | 68/17 R |
| 2004/0168483 | A1 * | 9/2004 | Kim et al. | 68/17 R |
| 2007/0125134 | A1 * | 6/2007 | Park | 68/17 R |
| 2010/0000022 | A1 * | 1/2010 | Hendrickson et al. | 8/137 |

* cited by examiner

*Primary Examiner* — Joseph L Perrin
*Assistant Examiner* — Levon J Shahinian
(74) *Attorney, Agent, or Firm* — Dority & Manning, P.A.

(57) ABSTRACT

A fluid additive dispenser is provided. The fluid additive dispenser includes a fluid additive collector that is disposed below containers configured for receipt of fluid additives. The fluid additive collector receives fluid additives from the containers and directs the fluid additives to a spout. By directing the fluid additives to the spout, spilling and leaking of the fluid additives can be reduced, e.g., during operation of a washing machine appliance.

20 Claims, 6 Drawing Sheets

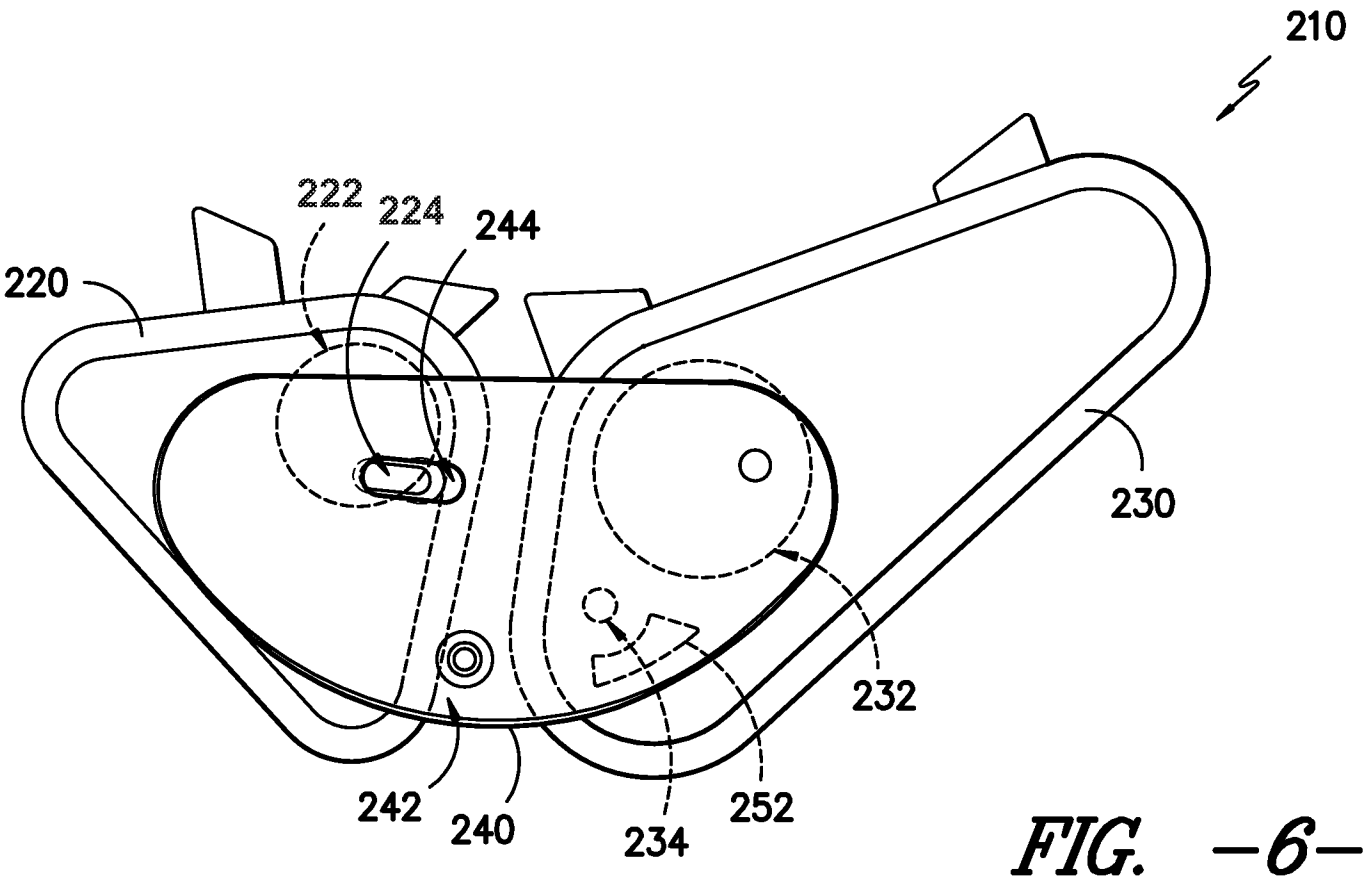
FIG. —6—

FLUID ADDITIVE DISPENSER

FIELD OF THE INVENTION

The present subject matter relates generally to fluid additive dispensers for appliances, e.g., washing machine appliances.

BACKGROUND OF THE INVENTION

Washing machine appliances generally form a wash fluid to clean clothing articles disposed within a wash basket of the appliance. The wash fluid can include water and various fluid additives, e.g., detergent, fabric softener, and/or bleach. The fluid additives can be mixed with water within a wash tub of the appliance in order to form the wash fluid.

To introduce fluid additive into the wash tub, a user can manually add the fluid additive to the wash tub and/or the wash basket. For example, after starting the appliance, the user can pour detergent directly into the wash basket. Conversely, certain washing machine appliances include features for receiving fluid additives and dispensing the fluid additives during operation of the appliance. For example, a tray or container mounted to a top panel of a vertical axis washing machine appliance can receive a fluid additive and direct the fluid additive into a wash tub of the appliance. Similarly, a horizontal axis washing machine appliance can include a drawer with a container mounted therein that receives a fluid additive and directs the fluid additive into a wash tub of the appliance.

However, in both vertical and horizontal axis washing machine appliances, a separate tray or container is generally provided for each particular fluid additive. Thus, for example, a washing machine appliance can require a container for detergent, a container for fabric softener, and a container for bleach. Certain design constraints can limit the effectiveness of using multiple containers to direct fluid additives into the wash tub.

In particular, the washing machine appliance's wash basket is typically rotatably mounted within the wash tub. Thus, the wash basket spins within the wash tub during operation of the appliance. The containers described above generally direct fluid additives into a gap defined between the wash tub and the wash basket. However, the location of the gap relative to the containers can change, particularly when the wash basket is spinning and the washing machine is installed out of level. In turn, fluid additive intended to be directed into the gap between the wash tub and wash basket can spill out of the appliance or onto articles in the wash basket when the shape of the gap changes. For example, bleach intended to be directed into the gap can damage clothing articles if the bleach is applied directly onto the articles in the wash basket rather than entering the gap between the wash tub and wash basket.

Accordingly, a washing machine appliance with features for improved handling of fluid additives would be useful. Also, a washing machine appliance with features for hindering spilling and/or leaking of fluid additives would be useful. In particular, a washing machine appliance with features for more reliably directing fluid additives into a gap between a wash basket and a wash tub of the appliance would be useful.

BRIEF DESCRIPTION OF THE INVENTION

The present subject matter provides a fluid additive dispenser. The fluid additive dispenser includes a fluid additive collector that is disposed below containers configured for receipt of fluid additives. The fluid additive collector receives fluid additives from the containers and directs the fluid additives to a spout. By directing the fluid additives to the spout, spilling and leaking of the fluid additives can be reduced, e.g., during operation of a washing machine appliance. Additional aspects and advantages of the invention will be set forth in part in the following description, or may be apparent from the description, or may be learned through practice of the invention.

In a first exemplary embodiment, a washing machine appliance is provided. The washing machine appliance includes a cabinet. A wash tub is mounted within the cabinet and configured for containing fluid during operation of the washing machine appliance. A wash basket is rotatably mounted within the wash tub and configured for receipt of articles for washing. The wash tub and the wash basket define a gap between the wash tub and the wash basket. A fluid additive collector is positioned adjacent the wash tub and the wash basket. The fluid additive collector includes a first container, a second container, and a fluid additive collector. The first container has an inlet and an outlet. The first container is configured for receiving a first fluid additive at the inlet of the first container and directing the first fluid additive to the outlet of the first container. The second container has an entrance and an exit. The second container is configured for receiving a second fluid additive at the entrance of the second container and directing the second fluid additive to the exit of the second container. The fluid additive collector is disposed vertically below the first container and the second container. The fluid additive collector defines a containment volume and a spout. The containment volume of the fluid additive collector is configured for receiving the first fluid additive from the outlet of the first container and the second fluid additive from the exit of the second container. The spout of the fluid additive collector is disposed above the gap of the wash tub and wash basket.

In a second exemplary embodiment, a fluid additive dispenser for a washing machine appliance is provided. The fluid additive dispenser includes a first container having an inlet and an outlet. The first container is configured for receiving a first fluid additive at the inlet of the first container and for directing the first fluid additive to the outlet of the first container. A second container has an entrance and an exit. The second container is configured for receiving a second fluid additive at the entrance of the second container and for directing the second fluid additive to the exit of the second container. A fluid additive collector is disposed vertically below the first container and the second container. The fluid additive collector defines a containment volume and a spout. The containment volume of the fluid additive collector is configured for receiving the first fluid additive from the outlet of the first container and the second fluid additive from the exit of the second container. The containment volume of the fluid collector is also configured for directing the first and second fluid additives to the spout of the fluid additive collector such that the first and second fluid additives exit the containment volume of the fluid additive collector at the spout of the fluid additive collector.

In a third exemplary embodiment, a washing machine appliance is provided. The washing machine appliance includes a cabinet. A wash tub is mounted within the cabinet and configured for containing fluid during operation of the washing machine appliance. A wash basket is rotatably mounted within the wash tub and configured for receipt of articles for washing. The wash tub and the wash basket define a gap between the wash tub and the wash basket. A fluid additive collector is positioned adjacent the wash tub and the wash basket. The fluid additive collector includes a container and a fluid additive collector. The container has an inlet and an outlet. The container is configured for receiving a fluid additive at the inlet of the container and directing the fluid additive to the outlet of the container. The fluid additive collector is disposed vertically below the container. The fluid additive collector defines a containment volume and a spout. The containment volume of the fluid additive collector is configured for receiving the fluid additive from the outlet of the container. The spout of the fluid additive collector is disposed above the gap of the wash tub and wash basket.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 3 shows fluid additive dispensers according to an exemplary embodiment of the present subject matter mounted above a wash basket and a wash tub of the washing machine appliance.

FIG. 6 illustrates a bottom view of the exemplary fluid additive dispenser of FIG. 3.

DETAILED DESCRIPTION

Figure 1:
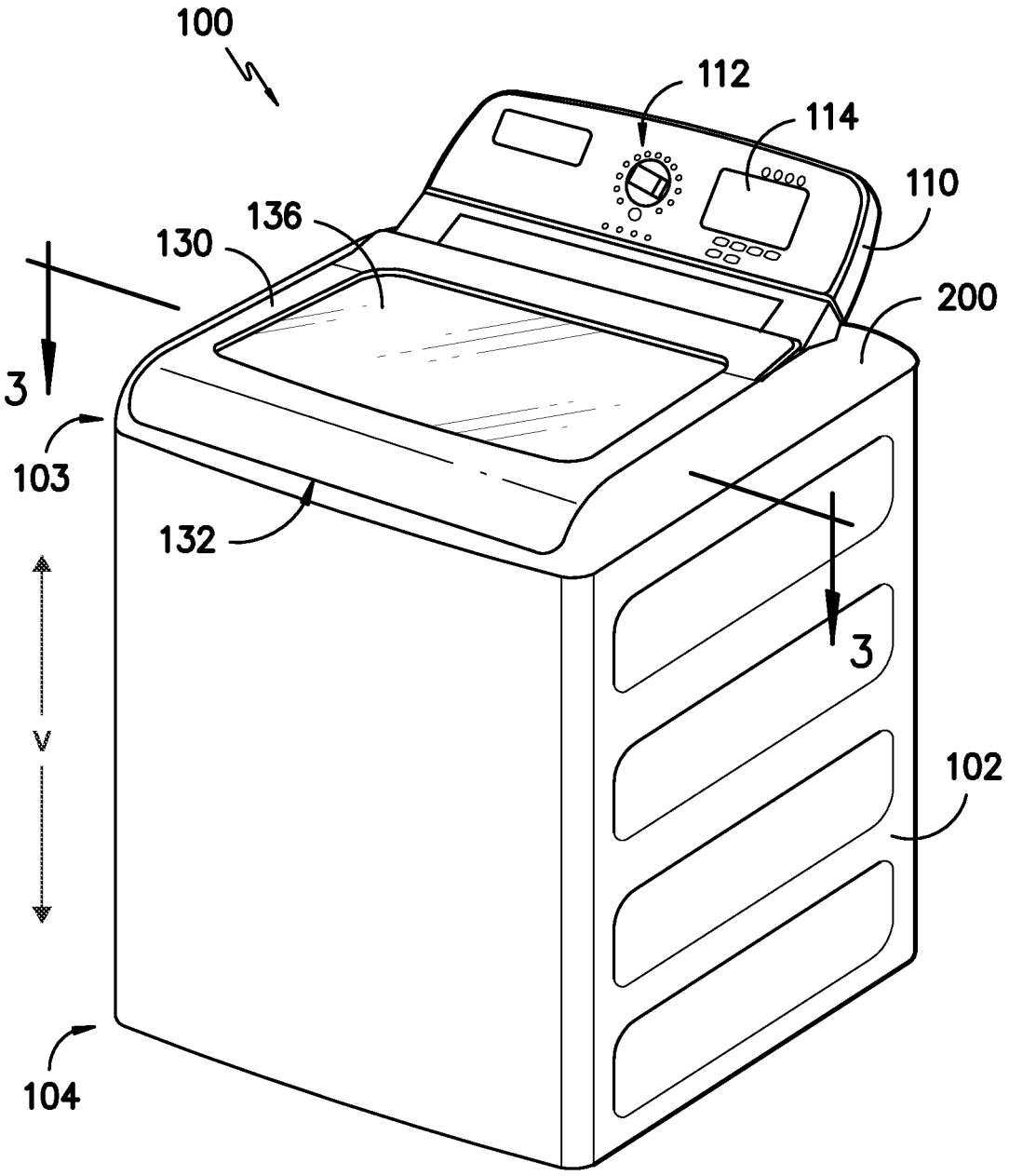
FIG. 1 provides a perspective view of an exemplary washing machine appliance according to an exemplary embodiment of the present subject matter with a door of the washing machine appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
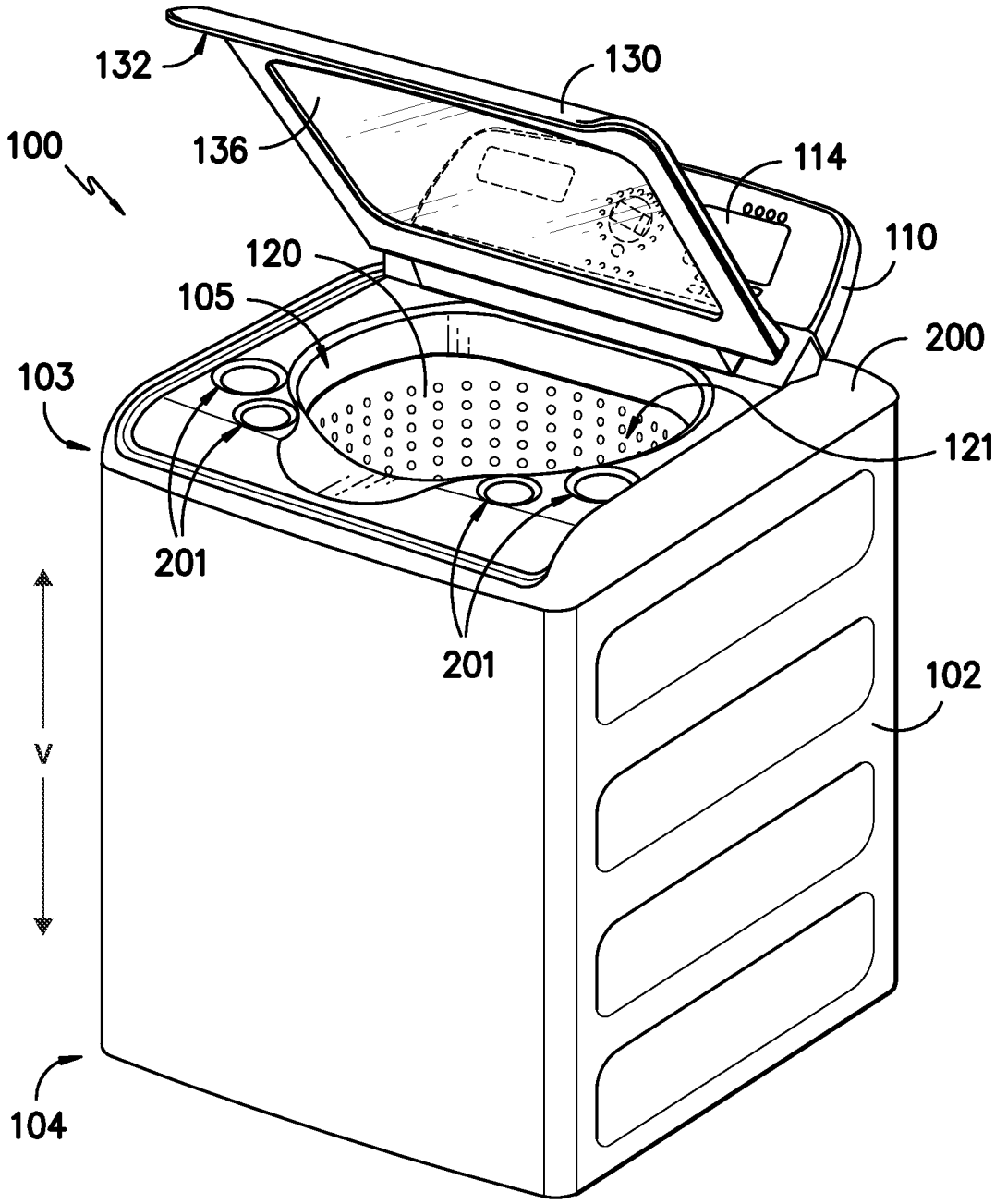
FIG. 2 illustrates a perspective view of the washing machine appliance of FIG. 1 with the door shown in an open position.

FIGS. 1 and 2 illustrate an exemplary embodiment of a vertical axis washing machine appliance 100. In FIG. 1, a lid or door 130 is shown in a closed position. In FIG. 2, door 130 is shown in an open position. While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well, e.g., horizontal axis washing machines.

Washing machine appliance 100 has a cabinet 102 that extends between a top 103 and a bottom 104 along a vertical direction V. A wash basket 120 (FIG. 2) is rotatably mounted within cabinet 102. A motor (not shown) is in mechanical communication with wash basket 120 in order to selectively rotate wash basket 120 (e.g., during an agitation or a rinse cycle of washing machine appliance 100). Wash basket 120 defines a wash chamber 121 (FIG. 2) that is configured for receipt of articles for washing. An agitator or impeller 140 (FIG. 3) extends from wash basket 120 into wash chamber 121. Impeller 140 assists agitation of articles disposed within wash chamber 121 during operation of washing machine appliance 100.

Cabinet 102 of washing machine appliance 100 has a top panel 200. Top panel 200 defines an opening 105 (FIG. 2) that permits user access to wash chamber 121 of wash basket 120. Door 130 is rotatably mounted to top panel 200. However, alternatively, door 130 may be mounted to cabinet 102 or any outer suitable support. Door 130 selectively rotates between the closed position shown in FIG. 1 and the open position shown in FIG. 2. In the closed position, door 130 inhibits access to wash chamber 121. Conversely, in the open position, a user can access wash chamber 121. A window 136 in door 130 permits viewing of wash chamber 121 when door 130 is in the closed position, e.g., during operation of washing machine appliance 100. Door 130 also includes a handle 132 that, e.g., a user may pull and/or lift when opening and closing door 130.

Top panel 200 defines a plurality of holes 201 (FIG. 2). Plurality of holes 201 are configured for receipt of a plurality of fluid additives, e.g., detergent, fabric softener, and/or bleach. In particular, each one of the plurality of holes 201 is configured for receipt of a particular one of the plurality of fluid additives. Plurality of holes 201 permit the plurality of fluid additives to pass through top panel 200 to a fluid additive dispenser 210 (FIG. 3) disposed below top panel 200 along the vertical direction V. Fluid additive dispenser 210 is described in greater detail below.

A control panel 110 with a plurality of input selectors 112 (FIG. 1) extends from top panel 200. Control panel 110 and input selectors 112 collectively form a user interface input for operator selection of machine cycles and features. A display 114 of control panel 130 indicates selected features, a countdown timer, and/or other items of interest to appliance users.

Operation of washing machine appliance 100 is controlled by a controller or processing device (not shown) that is operatively coupled to control panel 110 for user manipulation to select washing machine cycles and features. In response to user manipulation of control panel 110, the controller operates the various components of washing machine appliance 100 to execute selected machine cycles and features.

In an illustrative embodiment, laundry items are loaded into wash chamber 121 through opening 105, and washing operation is initiated through operator manipulation of input selectors 112. Wash basket 120 (or wash tub 119 shown in FIG. 3) is filled with water and detergent to form a wash fluid. One or more valves (not shown) can be controlled by washing machine appliance 100 to provide for filling wash basket 120 to the appropriate level for the amount of articles being washed. Once wash basket 120 is properly filled with fluid, the contents of wash chamber 121 are agitated (e.g., with impeller 140 shown in FIG. 3) for cleansing of laundry items in wash basket 120.

After the agitation phase of the wash cycle is completed, wash basket 120 is drained. Laundry articles can then be rinsed by again adding fluid to wash basket 120, depending on the particulars of the cleaning cycle selected by a user, impeller 140 may again provide agitation within wash chamber 121. One or more spin cycles may also be used. In particular, a spin cycle may be applied after the wash cycle and/or after the rinse cycle in order to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash chamber 121 through opening 105.

Figure 3:
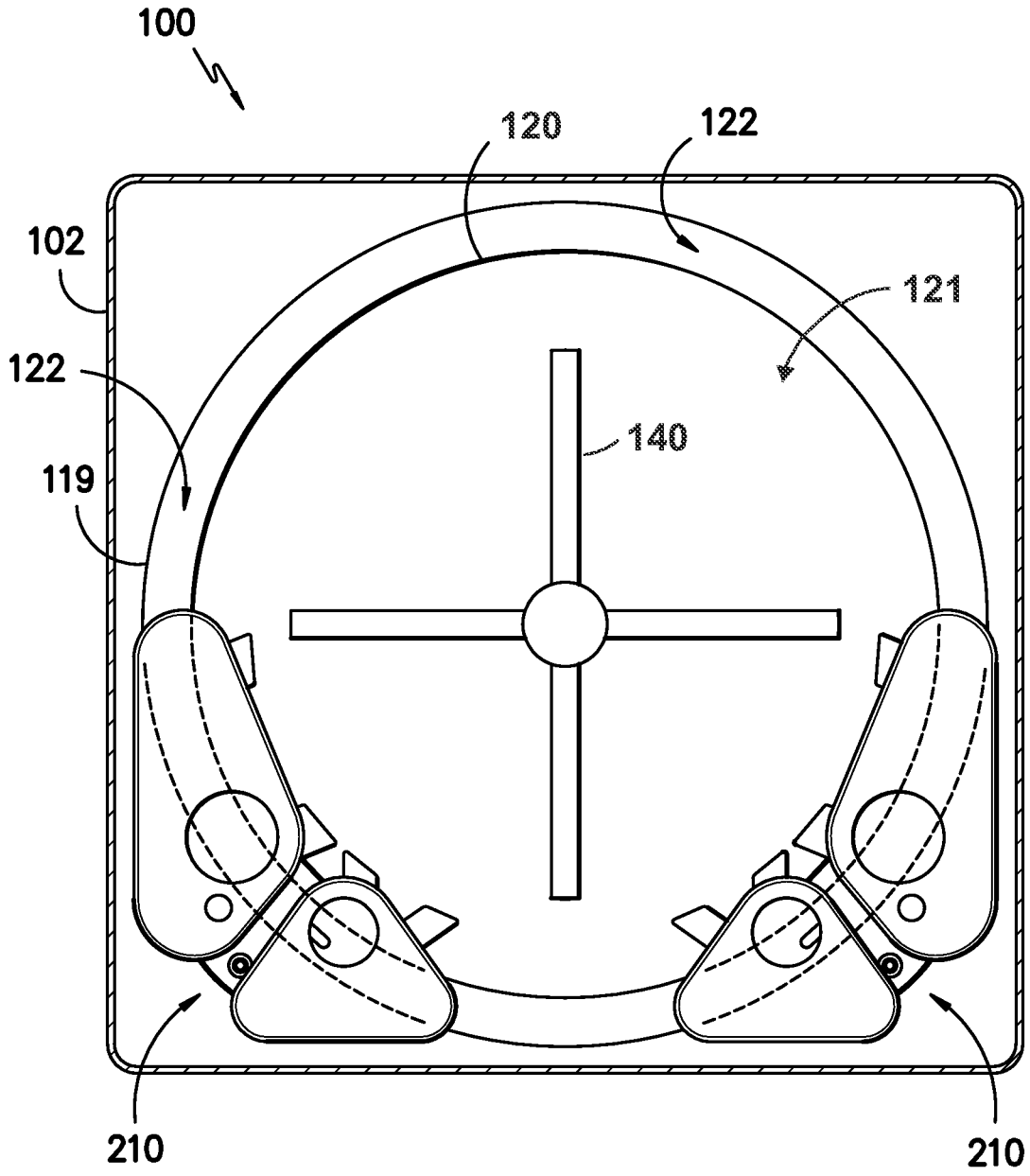
FIG. 3 is a top, cross-sectional view of the washing machine appliance of FIG. 1 taken along the 3-3 line shown in FIG. 1.

FIG. 3 is a top, cross-sectional view of washing machine appliance 100 taken along the 3-3 line shown in FIG. 1. An exemplary embodiment of fluid additive dispenser 210 is shown mounted above wash basket 120 and a wash tub 119 of washing machine appliance 100. As may be seen in FIG. 3, wash basket 120 is mounted within wash tub 119. In particular, wash basket 120 is rotatably mounted within wash tub 119 such that wash basket 120 is spaced apart from wash tub 119. In turn, wash tub 119 is mounted to cabinet 102, e.g., using springs or dampers (not shown) in order to reduce vibration of washing machine appliance 100 during rotation of wash basket 120. As will be understood by those skilled in the art, such dampers or springs permit wash tub 119 and wash basket 120 to displace or shift within cabinet 102. As an example, wash tub 119 and wash basket 120 can displace or shift within cabinet 102 due to an imbalance in the distribution of articles within wash basket 120 or due to washing machine appliance 100 operating in an out-of-level configuration.

Wash tub 119 is configured for containing wash and rinse fluids during operation of washing machine appliance 100 described above. Wash and rinse fluids disposed within wash tub 119 can be used to clean articles disposed in wash basket 120. Wash and rinse fluids can pass between wash basket 120 and wash tub 119 through a plurality of apertures defined by wash basket 120, e.g., during the wash and/or spin cycles described above.

Fluid additive dispensers 210 are mounted above wash tub 119 and wash basket 120 (e.g., along the vertical direction V shown in FIG. 1). More particularly, fluid additive dispensers 210 are mounted above a gap 122 (e.g., along the vertical direction V shown in FIG. 1). Gap 122 is defined between wash tub 119 and wash basket 120. Fluid additive dispensers 210 are configured for receipt of fluid additives from plurality of holes 201 (FIG. 2). Fluid additive dispensers 210 are also configured for directing the fluid additives into gap 122. For example, fluid additive dispensers 210 may direct detergent into gap 122 prior to a wash cycle of washing machine appliance 100. Similarly, fluid additive dispensers 210 may direct fabric softener into gap 122 prior to a rinse cycle of washing machine appliance 100.

As will be understood by those skilled in the art, gap 122 changes location within cabinet 102, e.g., relative to fluid additive dispensers 210 during operation of washing machine appliance 100. In particular, gap 122 will shift or displace when wash tub 119 and wash basket 120 shift or displace within cabinet 102 during rotation of wash basket 120 described above.

However, the range of travel of the wash tub 119 and wash basket 120 can be limited by the dampers or springs that mount the wash tub 119 to cabinet 102. Displacement of gap 122 is similarly limited by the dampers or springs, e.g., during operation of the washing machine appliance 100. Fluid additive dispenser 210 is disposed directly above (e.g., along the vertical direction V shown in FIG. 1) a location where gap 122 does not or is most likely to not displace away from during operation of washing machine appliance 100. In such a configuration, fluid additives are more likely to be directed into gap 122 rather than into wash basket 120 or out of wash tub 119. By positioning fluid additive dispenser 210 in such a manner, potential damage to articles in wash basket 120 due to misdirected fluid additives can be avoided and spills of fluid additives can also be limited.

Figure 4:
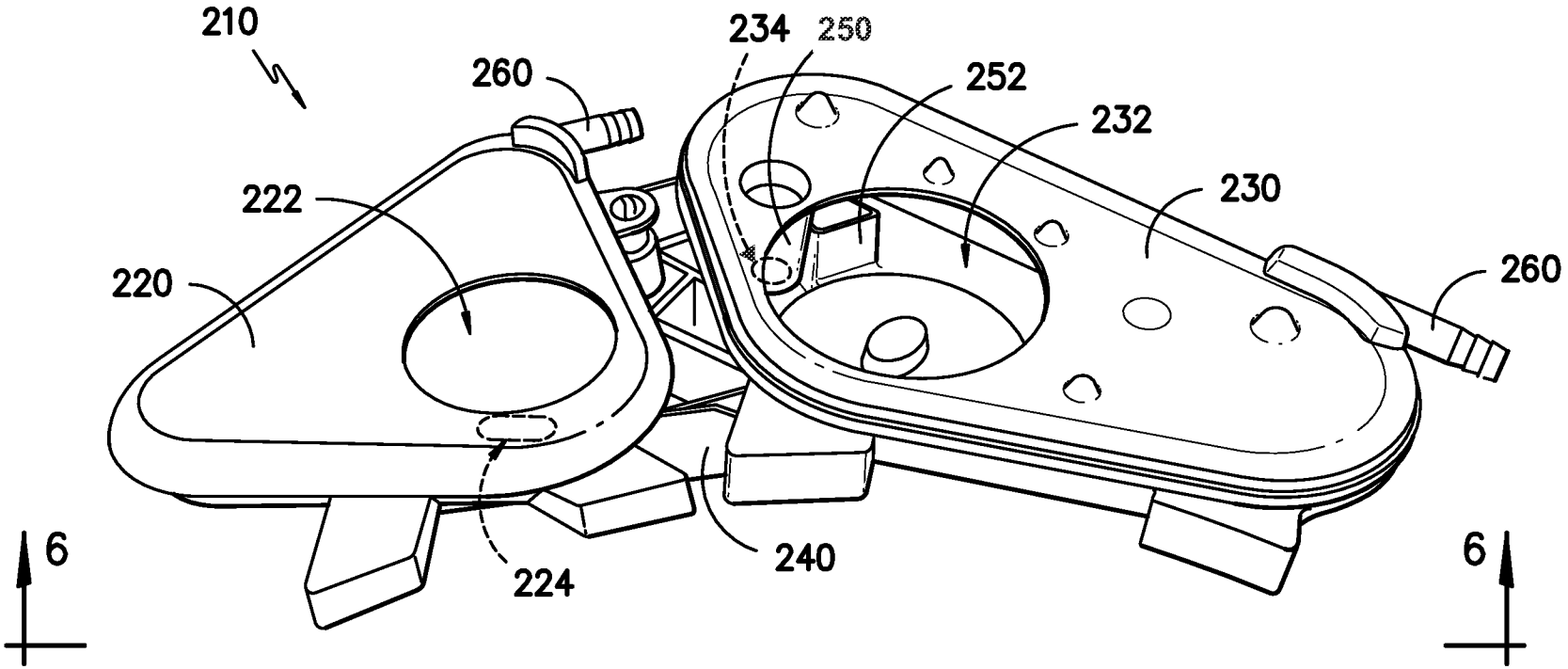
FIG. 4 is a perspective view of the exemplary fluid additive dispenser of FIG. 3.
Figure 5:
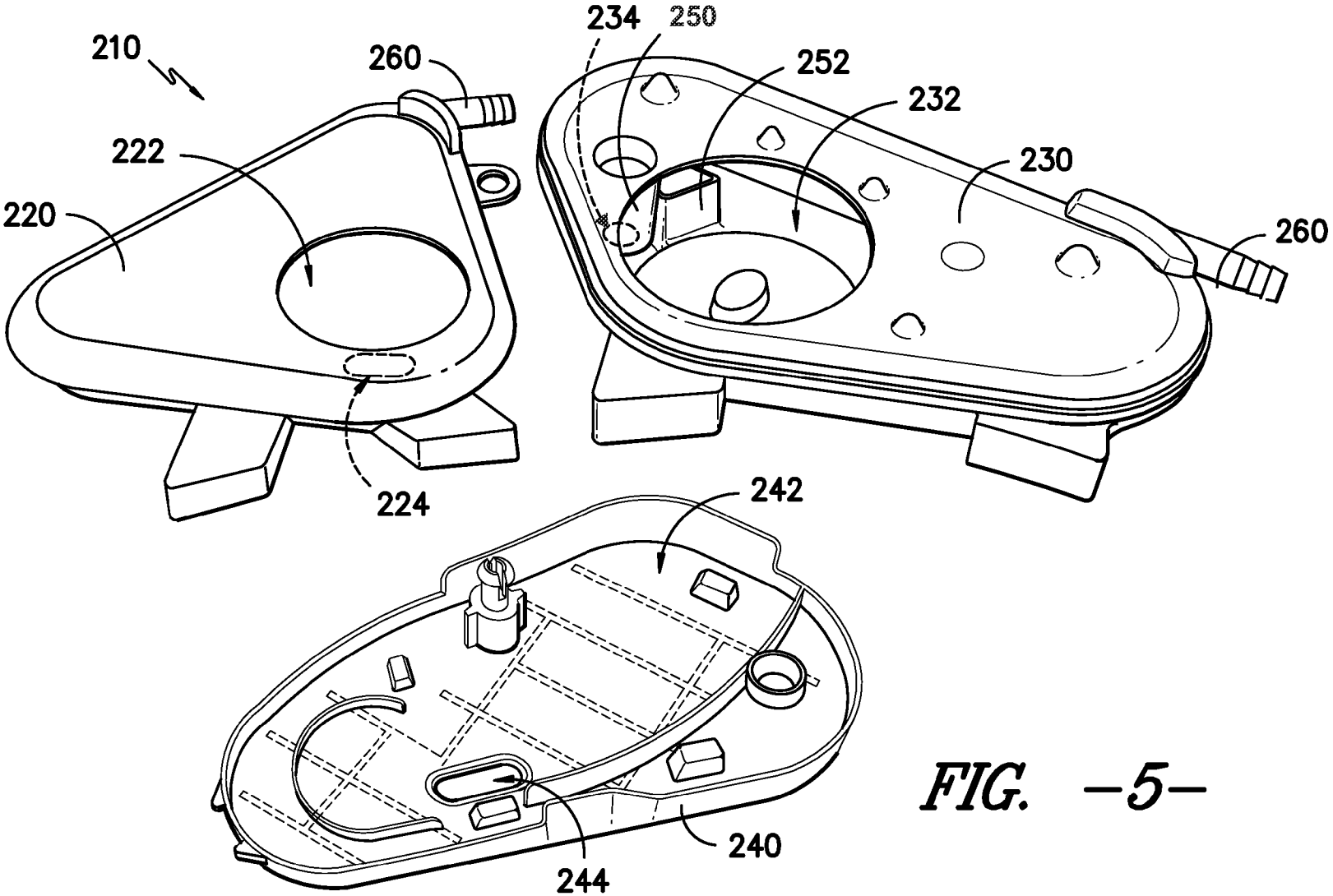
FIG. 5 is an exploded view of the exemplary fluid additive dispenser of FIG. 4.

FIG. 4 is a perspective view of one of fluid additive dispensers 210. FIG. 5 is an exploded view of such fluid additive dispenser 210. Fluid additive dispenser 210 may be constructed of any suitable material. For example, fluid additive dispenser 210 may be constructed of a plastic, a metal, or a combination of materials.

As may be seen in FIGS. 4 and 5, fluid additive dispenser 210 includes a first container or cup 220 and a second container or cup 230. First container 220 is configured for receipt of a first fluid additive, e.g., detergent. More particularly, first container 220 defines an inlet 222 that is aligned with and disposed below one of plurality of holes 201 of top panel 200 (FIG. 2). As an example, a user can pour detergent through the one of plurality of holes 201 such that the detergent passes into first container 220 through inlet 222. First container 220 also includes a water inlet 260. Water inlet 260 is in fluid communication with a water source (not shown), e.g., using a hose or other conduit. Water inlet 260 directs a selective flow of water into first container 220.

Second container 230 is configured for receipt of a second fluid additive, e.g., fabric softener. More particularly, second container 230 defines an entrance 232 that is aligned with another one of plurality of holes 201 of top panel 200. As an example, a user can pour fabric softener through the one of plurality of holes 201 such that the fabric softener passes into second container 230 through entrance 232. Second container 230 also includes a water inlet 260. Like first container 220, water inlet 260 of second container 230 is in fluid communication with the water source, and water inlet 260 of second container 230 directs a selective flow of water into second container 230.

Fluid additive dispenser 210 also includes a fluid additive collector 240 disposed vertically below first and second containers 220 and 230 (e.g., along the vertical direction V shown in FIG. 1). Collector 240 defines a containment volume 242 and a spout 244 (FIG. 5). Collector 240 is configured for receipt of first and second fluid additives from first and second containers 220 and 230 respectively as discussed in greater detail below.

First and second containers 220 and 230 can be mounted to collector 240. For example, first and second containers 220 and 230 may be secured to collector 240 using snap-fit fasteners, interference-fit fasteners, screws, glue, or combinations thereof.

As may be seen in FIGS. 5 and 6, first container 220 defines an outlet 224, and second container 230 defines an exit 234. First container 220 directs first fluid additive contained within first container 220 to outlet 224. At outlet 224, first fluid additive exits first container 220 and enters containment volume 242 of collector 240. Similarly, second container 230 directs second fluid additive contained within second container 230 to exit 234. At exit 234, second fluid additive exits second container 230 and enters containment volume 242 of collector 240. Thus, collector 240 receives first and second fluid additives from outlet 224 of first container 220 and exit 234 of second container 230 respectively.

As best seen in FIG. 5, first and/or second fluid additives disposed within containment volume 242 of collector 240 are directed out of collector 240 through spout 244. Spout 244 can direct such fluid additives into gap 122 (FIG. 3). Thus, spout 244 may be disposed vertically above gap 122 (e.g., along the vertical direction V shown in FIG. 1) such that gravity urges such fluid additives out of containment volume 242 through spout 244.

FIG. 6 illustrates a bottom view of fluid additive dispenser 210. As shown in FIG. 6, outlet 224 is configured such that gravity urges first fluid additive within first container 220 towards outlet 224 where such fluid additive can flow out of first container 220 through outlet 224. Further, outlet 224 is disposed above and in-line with spout 244 of collector 240. Thus, first fluid additive exiting first container 220 through outlet 224 can flow through containment volume 242 directly into spout 244.

Conversely, turning back to FIGS. 4 and 5, second container 230 includes a siphon valve 250 and an overflow or flow outlet 252. Siphon valve 250 regulates the flow of second fluid additive out of exit 234 as will be understood by those skilled in the art. As an example, a flow of water into second container 230 can be initiated through water inlet 260. Such water can mix with second fluid additive within second container 230 and fill second container 230 to a particular level until siphon valve 230 forms a siphon and drains second container 230 of the water and second fluid additive solution. Flow outlet 252 is configured for directing liquid from second container 230 to collector 240. In particular, flow outlet 252 prevents second container 230 from filling with more than a particular volume of liquid. Flow outlet 252 is provided so that if siphon valve 250 fails operate second container 230 will not overflow in an uncontrolled manner.

As an example, prior to starting washing machine appliance 100, a user can pour detergent through one of plurality of holes 201 (FIG. 2) into inlet 222 of first container 220. First container 220 will direct such detergent to outlet 224 of first container 220. In addition, water from water inlet 260 can be directed into first container 220 in order to rinse first container 220 of detergent and assist with forming wash fluid.

Similarly, in another example, prior to starting washing machine appliance 100, a user can pour fabric softener through another one of plurality of holes 201 (FIG. 2) into entrance 232 of second container 230. Subsequently, e.g., during a rinse cycle of washing machine appliance 100, water from water inlet 260 can be directed into second container 230 where the water can mix with the fabric softener. Eventually, sufficient liquid (i.e., fabric softener and water) will fill second container 230 to form a siphon in siphon valve 250. At that time, the water and fabric softener solution will be drawn by siphon valve 250 to exit 234 of second container 230.

Turning now to FIG. 5, in both examples described above, the detergent and fabric softener will be directed into containment volume 242 of collector 240. In turn, collector 240 will direct such liquid to spout 244 where such liquid flows into gap 122 (FIG. 3) between wash tub 119 and wash basket 120. In particular, collector 240 permits liquids from first and second containers 220 and 230 to be directed to the same portion of gap 122. Conversely, outlet 224 and exit 234 would direct liquid to different portions of gap 122 without collector 240 thereby increasing the potential for spills and/or other inaccuracies in fluid additive dispensing.

As described above, gap 122 can change location during operation of washing machine appliance 100. By positioning spout 244 of collector 244 above a portion of gap 122 that, e.g., is unlikely to be affected by rotation of wash basket 120 and movement of gap 122, collector 240 can improve delivery of fluid additives to gap 122 by decreasing spills of fluid additive out of wash tub 119 and/or into wash basket 120.

It should be understood that the fluid additive dispenser 210 described above is provided by way of example only. For example, in alternative exemplary embodiments, fluid additive dispenser 210 may include additional containers, e.g., one, two, or more additional containers. Also, in FIG. 3, only two fluid additive dispensers 210 are mounted to washing machine appliance 100. However, washing machine appliance 100 may include additional fluid additive dispensers, e.g., one, two, or more additional fluid additive dispensers, e.g., mounted to a back of top panel 200 rather than a front of top panel 200 as shown in FIG. 2.

In addition, it should be understood that the fluid additive dispenser 210 can receive fluid additives from bulk fluid additive dispensing system (not shown). For example, reservoirs may be disposed within cabinet 102. Further, the reservoirs may be sized such that a volume of fluid additive sufficient for a plurality or multitude of wash cycles of washing machine appliance 100 (e.g., five, ten, twenty, fifty, or any other suitable number of wash cycles) may fill the reservoirs. Thus, for example, a user can fill each one of the reservoirs with a particular fluid additive and operate washing machine appliance 100 for a plurality of wash cycles without refilling the reservoirs with fluid additives. A pump (not shown) may selectively deliver the fluid additives from the reservoirs to the first and second containers 220 and 230 respectively.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A vertical axis washing machine appliance comprising:

a cabinet having a top panel that defines a plurality of holes at a front portion of the top panel;

a wash tub mounted within said cabinet and configured for containing fluid during operation of the washing machine appliance;

a wash basket rotatably mounted within said wash tub such that said wash basket is rotatable about a substantially vertical axis, said wash basket configured for receipt of articles for washing, said wash tub and said wash basket defining a gap between said wash tub and said wash basket;

a fluid additive dispenser positioned below the top panel of said cabinet and adjacent said wash tub and said wash basket, said fluid additive dispenser comprising:

a first container having an inlet and an outlet, said first container configured for receiving a first fluid additive at the inlet of said first container and directing the first fluid additive to the outlet of said first container;

a second container having an entrance and an exit, said second container configured for receiving a second fluid additive at the entrance of said second container and directing the second fluid additive to the exit of said second container; and a fluid additive collector disposed vertically below said first container and said second container, said fluid additive collector defining a containment volume and a spout, the containment volume of said fluid additive collector positioned for receiving the first fluid additive from the outlet of said first container and the second fluid additive from the exit of said second container, the spout of said fluid additive collector disposed above the gap of said wash tub and wash basket, the spout of said fluid additive collector also positioned such that said wash basket is not positioned directly below the spout of said fluid additive collector, the spout of said fluid additive collector positioned such that the spout of said fluid additive collector is not disposed directly below the exit of said second container;

wherein the inlet of said first container and the entrance of said second container are positioned at a respective one of the plurality of holes of the top panel.

2. The washing machine appliance of claim 1, wherein the spout of said fluid additive collector is a single opening.

3. The washing machine appliance of claim 1, wherein said top panel of said cabinet defines a first hole and a second hole, the first hole of said top panel aligned with the inlet of said first container, the second hole of said top panel aligned with the entrance of said second container.

4. The washing machine appliance of claim 1, wherein said first and second containers are mounted to said fluid additive collector.

5. The washing machine appliance of claim 1, wherein said first and second containers are mounted to said fluid additive collector with snap-fit fasteners.

6. The washing machine appliance of claim 1, wherein the outlet of said first container is positioned directly above the spout of said fluid additive collector.

7. The washing machine appliance of claim 1, further comprising a siphon valve mounted to said second container and in fluid communication with the exit of said second container in order to regulate the flow of second fluid additive out of the exit of said second container.

8. The washing machine appliance of claim 1, further comprising a flow valve mounted to said second container and configured for directing second fluid additive from within said second container to the containment volume of said fluid additive collector when the second fluid additive fills said second container above a particular fluid level.

9. The washing machine appliance of claim I, further comprising a first water inlet mounted to said first container and configured for directing water into said first container and a second water inlet mounted to said second container and configured for directing water into said second container.

10. The washing machine appliance of claim 1, wherein said first and second containers and said fluid additive collector are constructed of plastic.

11. The washing machine appliance of claim 1, wherein the first and second fluid additives only flow into the gap of said wash tub and wash basket via the spout of said fluid additive collector.

12. A fluid additive dispenser for a vertical axis washing machine appliance, the fluid additive dispenser defining a vertical direction, the fluid additive dispenser comprising:

a first container having an inlet and an outlet, said first container configured for receiving a first fluid additive at the inlet of said first container and for directing the first fluid additive to the outlet of said first container;

a second container having an entrance and an exit, said second container configured for receiving a second fluid additive at the entrance of said second container and for directing the second fluid additive to the exit of said second container; and a fluid additive collector disposed below said first container and said second container along the vertical direction, said fluid additive collector defining a containment volume and a spout, the containment volume of said fluid additive collector positioned directly below the outlet of said first container and the exit of said second container such that the containment volume of said fluid additive collector is positioned for receiving the first fluid additive from the outlet of said first container and the second fluid additive from the exit of said second container, the containment volume of said fluid collector also configured for directing the first and second fluid additives to the spout of said fluid additive collector such that the first and second fluid additives exit the containment volume of said fluid additive collector at the spout of said fluid additive collector, the spout of said fluid additive collector positioned such that the spout of said fluid additive collector is not disposed directly below the exit of said second container;

wherein said first container, said second container and said fluid additive collector are discrete from one another.

13. The fluid additive dispenser of claim 12, wherein said first and second containers are mounted to said fluid additive collector.

14. The fluid additive dispenser of claim 12, wherein said first and second containers are mounted to said fluid additive collector with snap-fit fasteners.

15. The fluid additive dispenser of claim 12, wherein the outlet of said first container is positioned directly, vertically above the spout of said fluid additive collector.

16. The fluid additive dispenser of claim 12, further comprising a siphon valve mounted to said second container and in fluid communication with the exit of said second container in order to regulate the flow of second fluid additive out of the exit of said second container.

17. The fluid additive dispenser of claim 12, further comprising a flow valve mounted to said second container and configured for directing second fluid additive from within said second container to the containment volume of said fluid additive collector when the second fluid additive fills said second container above a particular fluid level.

18. The fluid additive dispenser of claim 12, further comprising a first water inlet mounted to said first container and configured for directing water into said first container and a second water inlet mounted to said second container and configured for directing water into said second container.

19. The fluid additive dispenser of claim 12, wherein said first and second containers and said fluid additive collector are constructed of plastic.

20. A vertical axis washing machine appliance comprising:

a cabinet having a top panel that defines a hole at a front portion of the top panel;

a wash tub mounted within said cabinet and configured for containing fluid during operation of the washing machine appliance;

a wash basket rotatable mounted within said wash tub such that said wash basket is rotatable about a substantially vertical axis, the wash basket configured for receipt of articles for washing, said wash tub and said wash basket defining a gap between said wash tub and said wash basket;

a fluid additive dispenser positioned below the top panel of said cabinet and adjacent said wash tub and said wash basket, said fluid additive dispenser comprising:

a container having an inlet and an outlet, said container configured for receiving a fluid additive at the inlet of said container and directing the fluid additive to the outlet of said container; and a fluid additive collector disposed vertically below said container, said fluid additive collector defining a containment volume and a spout, the containment volume of said fluid additive collector positioned for receiving the fluid additive from the outlet of said container, the spout of said fluid additive collector disposed above the gap of said wash tub and wash basket, the spout of said fluid additive collector also positioned such that said wash basket is not positioned directly below the spout of said fluid additive collector, the spout of said fluid additive collector positioned such that the spout of said fluid additive collector is not disposed directly below the outlet of the container, a bottom wall of said fluid additive collector extending around the spout of said fluid additive collector, the bottom wall of said fluid additive collector sloped towards the spout of said fluid additive collector;

wherein the inlet of said container is positioned at the hole of the top panel.

* * * * *